United States Patent [19]

Cnare

[11] 4,367,065

[45] Jan. 4, 1983

[54] METHOD FOR FIRING COAL IN PYRO-PROCESSES USING DIRECT HEAT RECUPERATION FROM A CROSS FLOW HEAT EXCHANGER

[75] Inventor: Robert F. Cnare, Pewaukee, Wis.

[73] Assignee: Allis-Chalmers Corporation, Milwaukee, Wis.

[21] Appl. No.: 236,724

[22] Filed: Feb. 23, 1981

[51] Int. Cl.[3] ..... F27B 15/00; F23D 1/00

[52] U.S. Cl. ..... 432/14; 432/106; 432/78; 110/347

[58] Field of Search ..... 110/224, 229, 347; 432/14, 78, 82, 106

[56] References Cited

U.S. PATENT DOCUMENTS

| | | | |
|---|---|---|---|
| 3,276,755 | 10/1966 | Bast | 432/78 |
| 3,627,287 | 12/1971 | Herz | 432/106 |
| 4,078,882 | 3/1978 | Houd | 432/14 |
| 4,120,645 | 10/1978 | Heian et al. | 432/14 |
| 4,280,418 | 7/1981 | Erhard | 432/78 |

*Primary Examiner*—Henry C. Yuen

*Attorney, Agent, or Firm*—Arthur M. Streich

[57] ABSTRACT

Coal is placed upon hot mineral solids being cooled by an upward flow of ambient air; the coal is dried, ignited and completely combusted under process conditions associated with cooling after firing. The hot off-gas from cooling is returned directly to the firing section or other sections of the process as heat.

6 Claims, 2 Drawing Figures

METHOD FOR FIRING COAL IN PYRO-PROCESSES USING DIRECT HEAT RECUPERATION FROM A CROSS FLOW HEAT EXCHANGER

BACKGROUND OF THE INVENTION

Present day energy shortages have spurred activity in industries of all types to find methods of utilizing indigenous sources of fuel. The price of fuel oil and natural gas is increasing and the availability of these fuels in many areas of the world is decreasing. Under these conditions coal becomes a viable source of alternate fuel.

In the pyro-processing of minerals for the purposes of agglomeration and induration, or conducting high temperature reactions, coal must, in the present state of the art, be dried and finely pulverized before it can be used as a fuel. There are high capital, labor, maintenance, thermal and electrical energy costs associated with such preparation of coal for use as fuel.

The ash contained in the pulverized coal also enters the process and may, depending upon its specific characteristics, remain unaltered or melt to form a viscous slag in that portion of the process where combustion is occurring. The ash may undesirably contaminate the product irrespective of what occurs during combustion. If the ash is unaltered, it becomes entrained because of its extreme fineness in gaseous products of combustion and other gases and exits the process as an atmospheric pollutant. If the ash tends to melt, it will also be carried by the process gases and adhere to the inner surfaces of the processing equipment wherever the process gas stream impacts. Wherever this adherence occurs, accretions build by the adhesive ash capturing product dust. The building of such accretions can consume the valuable product, and impair process operations and economics. Presently each process is best operated with coals having rather specific limits on ash content and characteristic. The ability of mineral pyro-processing industries to utilize either lowest cost or best available coals is, therefore, restricted.

Wherever possible, mineral pyro-processing employs recuperative product cooling to reduce fuel consumption. If the hot product is non-reactive and sufficiently dimensionally stable to be cooled in the form of gas permeable bed, the cooling medium is air. Such cooling is done with a forced upward flow of air with the permeable bed moving either downwards or horizontally, depending upon the design of the cooler. As the air flows upwards through the bed it removes heat from the bed and leaves the top of the bed heated to a high temperature.

The hot air leaving the bed is then returned to the process where it is utilized as hot combustion air for combustion efficiency and as a significant source of process heat.

In an attempt to reduce energy use, many methods have been devised to utilize waste heat from the process system with various degrees of success. Examples of methods to utilize system heat are disclosed in U.S. Pat. Nos. 2,466,601; 2,580,235; 2,925,336; 3,110,483; 3,110,751; 3,313,534; 3,416,778; 3,627,287; 3,653,645; 3,671,027; and 3,782,888.

In U.S. Pat. No. 2,466,601 there is disclosed a method of obtaining thermodynamic balance of heat among various units of a pyro-process system.

The aforementioned U.S. Pat. No. 3,313,534 discloses a system including a two-stage cooler, with preheat air from the first cooler stage passing into the kiln and the secondary air being discharged to atmosphere as waste heat, an auxiliary burner over the grate and a bypass is provided for some of the gas from the kiln to pass directly to the drying chamber. In such a system, a regulated quantity of kiln gas that has not passed through material in the preburn chamber may be mixed with gas that has passed through the material in the preburn chamber and the mixture passed through material in the drying chamber. Although this system achieves proper thermodynamic balance, it requires more fuel and a kiln about 20 percent larger in diameter than is required for a system such as the one in which the present invention is incorporated, for a reason that will appear and be explained as the description of prior art proceeds.

U.S. Pat. No 2,580,235 discloses bypassing preheated air from the cooler around the kiln and the preburn chambers to drying chambers and additionally discloses one embodiment in which kiln gas can also be bypassed to a drying chamber without passing through material in the preburn chamber. However, such systems also require oversized kilns (as compared to the kiln size required for the about to be described present invention) for a reason that will now be explained. Oversized kilns are required because at startup and before hot pellets reach the cooler, the cooler provides no heat and all heat needed for the chambers over the grate must come from the gases passing through the kiln. Accordingly, the kiln must be sized to accommodate that greater (temporary) gas flow until hot pellets reach the cooler where some of their heat can be recovered and bypassed around the kiln to the chambers over the grate.

The aforesaid U.S. Pat. Nos. 3,416,778 and 3,653,645 (in addition to U.S. Pat. No. 3,313,534) also disclose burners over a grate for aiding to achieve proper preburning on a grate ahead of the kiln. The burners over the grate in U.S. Pat. Nos. 3,313,534; 3,416,778; and 3,653,645 can affect the temperature of gases used for drying but after pellets begin to pass from the drying chamber into the preburn chamber, the preburning operation utilizes heat which is, therefore, no longer available for the drying operation. Such systems, therefore, also require oversized kilns for overfiring the burners over the grate. Overfiring the above grate burners in the preburn chamber merely to provide excess heat for drying operations is undesirable, because in so doing it can heat the upper layers of pellets in the preburn chamber beyond the preburn desired before the pellets begin to tumble through a kiln.

U.S. Pat. No. 3,671,027 discloses apparatus for transmitting kiln exhaust gas from a preburn section to one chamber of a drying section and utilizing heat at a desired or controlled temperature from the cooling zone to the second chamber of the drying section so as to condition the material in the second chamber. Heat control is dependent on the mechanical point of connection of the conduit which conducts the cooler gases to the second drying chamber along with baffle settings. There is no attempt to utilize a low cost solid fuel as process energy.

In U.S. Pat. No. 3,627,287 there is disclosed a gas supply pipe for secondary preheating intake air in the throat portion of a clinker cooler in a manner that the gas is supplied directly into the path of the preheated upstream flowing to the downstream end of a kiln. The purpose is to supply controllable additional heat to the secondary air prior to combustion of the main fuel stream in the kiln and thereby control the combustion within the kiln to vary the regional location within the kiln at which hot gas reaches temperatures in excess of the material's maximum temperature.

U.S. Pat. No. 3,782,888 is directed to the problems of reducing kiln size and fuel requirements relative to tonnages of material treated, and providing controlled thermodynamic balance in such systems by the utilization of air heating means such as an auxiliary burner, at a novel location.

As can be seen, all of the aforementioned patents disclose various methods of utilizing energy either as an addition or as recouped air or a combination of both. All have in common the conservation of high cost energy and attempt to make a more efficient use of the energy required, but none of the foregoing teach adding fuel to the material bed in the cooling zone and utilizing the generated heat in the kiln or final heat treatment zone.

The present invention is directed to the concept of distributing minimally crushed coal or any other solid fuel on the top of the cooling bed when the bed and hot air leaving it are hot enough to cause ignition and sustain stable combustion. The temperature and heat content of the air leaving the cooler and returning to the process are thereby significantly increased resulting in a substantial reduction of pulverized coal consummed in the process. It will be apparent that in the practice of this invention the cost and energy requirements of coal pulverizing are reduced.

The ash contained in the solid fuel fed to the cooler has not been reduced to a finely divided state and in the main is incapable of being entrained in the hot air leaving the bed and being returned to the process. This expands any limits imposed on the quantity and characteristics of the ash in the solid fuel fed to the cooler with respect to accretion build up or atmospheric pollution. The effect of product contamination by the coal ash is significantly diminished as it is not dispersed throughout the product but largely segregated to the product at the top of the cooling bed. As the ash is of relatively large size, it is relatively simple to distinguish and remove it from the product.

More specifically, the present invention is directed to the concept of adding coal into the cooler of a pyro-processing system. This, as far as applicant is aware, has never been undertaken because of fusion effect which has always appeared to be a serious impediment which deterred persons skilled in the art from exploring this method of reducing energy consumption.

SUMMARY OF THE INVENTION

According to the present invention, provision is made to place coal upon hot pellets being cooled by an upwards flow of ambient air. The added coal will be dried, ignited and completely combusted under process conditions normally associated with primary cooling after firing. The hot gas from the combustion of the added coal is utilized in the firing in the final heat treatment zone or other section of the process. The added coal need not be dried, nor does it require to be pulverized, thus effecting a considerable saving over the method wherein pulverized coal or oil is blown into the firing section.

DESCRIPTION OF THE INVENTION

Figure 1:
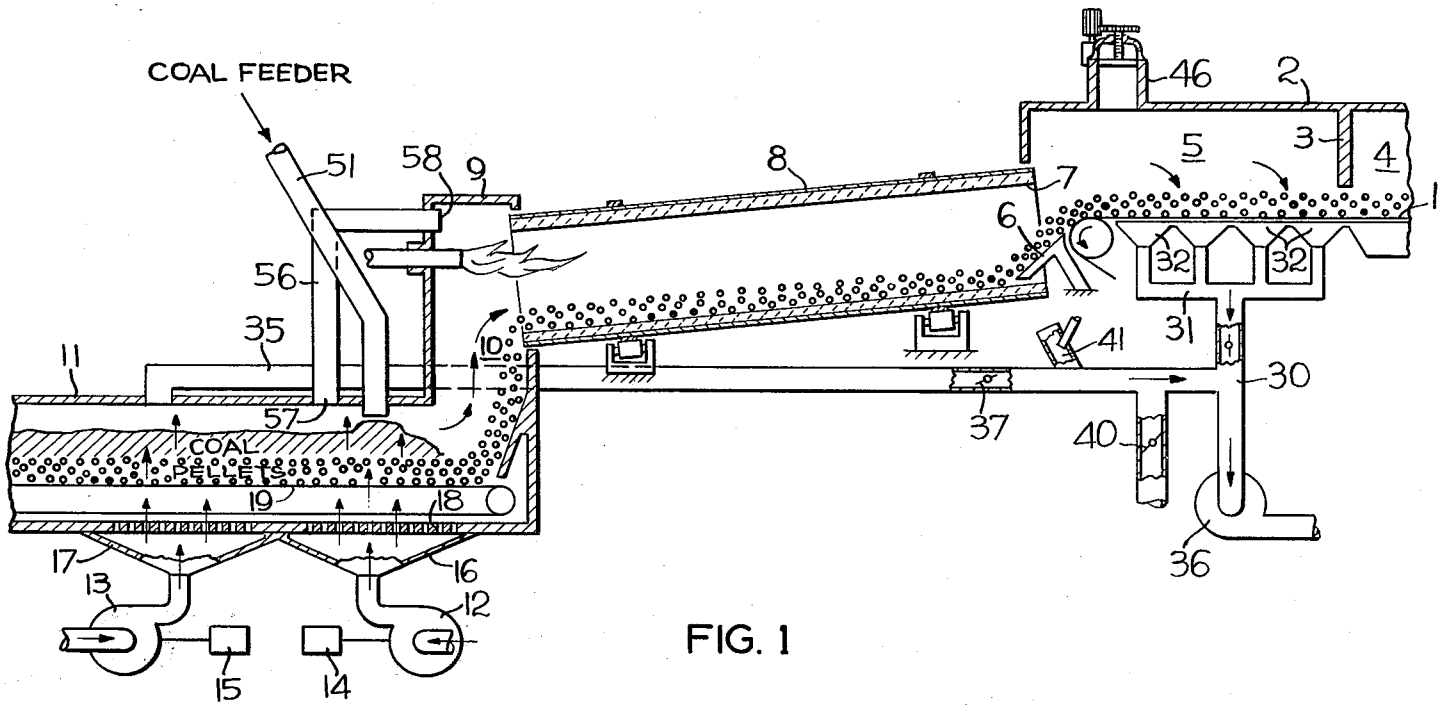
FIG. 1 is a fragmentary diagrammatic view, in vertical section, of a pyro-processing system in which the invention is incorporated.
Figure 2:
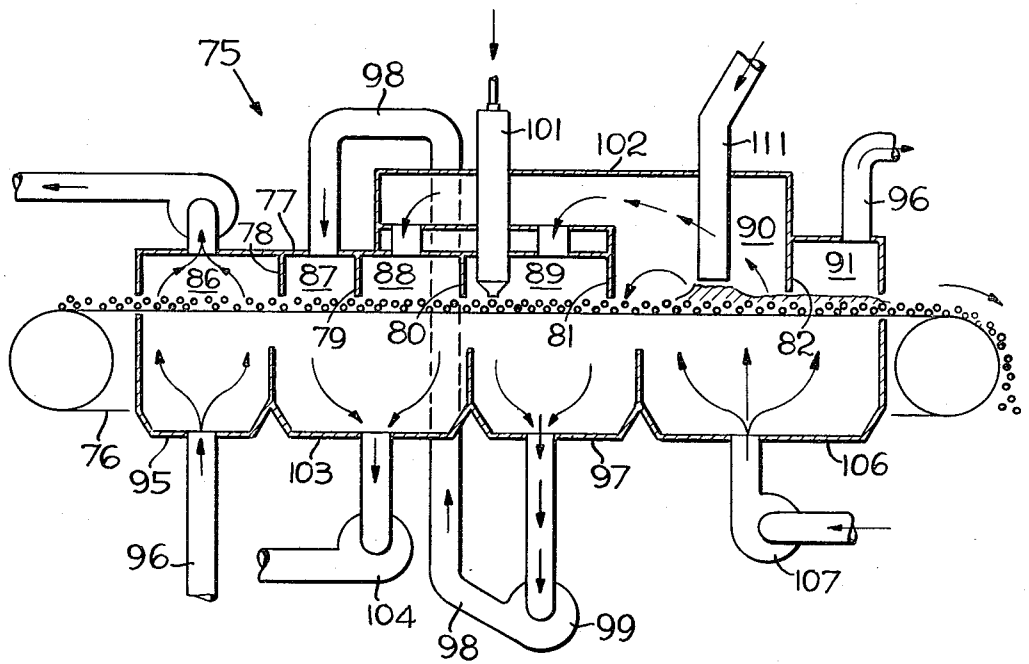
FIG. 2 is a fragmentary diagrammatic view in section of a straight grate type of pyro-processing system in which cooling is accomplished by cross flow solids to air heat transfer.

The preferred application of this invention is to mineral pyro-processes in which cooling is accomplished by cross flow solids to air heat transfer. This method of cooling is done in devices that convey a gas permeable bed in a plane sufficiently horizontal such that there is no relative movement between product particles.

The invention applies to any pyro-process having at least two chambers; one to heat solids to a specific high temperature in an oxidizing atmosphere and the other to cool the solids as a packed or permeable bed by cross flow solids to air heat transfer. The two chambers must be interconnected so that all or part of the heated air leaving the cooling chamber is returned to the heating chamber for the purpose of returning to the heating chamber a substantial amount of the heat required to heat the solids.

The temperature of the air returned from the cooling chamber to the heating chamber will be less than the specific temperature to which the solids must be raised and fuel must be combusted and transmitted to the heating chamber, returning a substantial amount of the heat required for heating the solids.

The hot air returned from the cooling chamber will be less than the temperature specifically required to process the solids and must be elevated in temperature by the combustion of fuel.

The temperature of the air returned from the cooling chamber to the heating chamber will be less than the specific temperature to which the solids must be raised and fuel must be combusted to raise the temperature of the air above.

This invention applies to any pyro-process that has one or more chambers in which fuel is fired for heating material to high temperature and in which the heated material is cooled as a packed bed by cross flow solids to air heat transfer for the purpose of returning sensible heat from the cooling bed to the process to reduce fuel consumption. The purpose of the invention is to partially substitute solid fuel of low or random quality for coals of specific and controlled quality, natural gas or fuel oil required for acceptable operation of the process chambers provided for material heating.

The heating chambers referred to are rotary kilns wherein materials are heated by flame radiation or external combustion chambers providing hot gas for packed bed, cross flow, gas-to-solids heat transfer as used on traveling grates. Such chambers are used in iron ore pelletizing in two types of processes, the Grate Kiln and the Straight Grate. The traveling grate is used in both processes. In the Grate Kiln System, it is used to dry and preliminarlly indurate iron ore agglomerates sufficiently for final high temperature induration in a rotary kiln. In the straight grate process, the grate is extended to include final induration and recuperative cooling.

The invention is described as it would be applied to a great kiln system arrangement as an example of suitable